US005100375A

United States Patent [19]

Koch

[11] Patent Number: 5,100,375

[45] Date of Patent: Mar. 31, 1992

[54] INCUBATOR FOR INFANTS

[75] Inventor: Jochim Koch, Ratzeburg, Fed. Rep. of Germany

[73] Assignee: Drägerwerk Aktiengesellschaft, Lubeck, Fed. Rep. of Germany

[21] Appl. No.: 672,856

[22] Filed: Mar. 20, 1991

[30] Foreign Application Priority Data

Mar. 20, 1990 [DE] Fed. Rep. of Germany ..... 4008822

[51] Int. Cl.[5] ..... A61G 11/00

[52] U.S. Cl. ..... 600/22

[58] Field of Search ..... 600/22

[56] References Cited

U.S. PATENT DOCUMENTS

| | | | |
|---|---|---|---|
| 3,782,362 | 1/1974 | Puzio | 600/22 |
| 4,509,505 | 4/1985 | Mercey et al. | 600/22 |
| 4,617,912 | 10/1986 | Beer et al. | 600/22 |
| 4,846,783 | 7/1989 | Koch | 600/22 |

*Primary Examiner*—William E. Kamm
*Assistant Examiner*—Scott M. Getzow
*Attorney, Agent, or Firm*—Walter Ottesen

[57] ABSTRACT

The invention is directed to an incubator for infants wherein air is supplied from an air supply opening arranged between the side walls of the incubator hood and the supporting member defining a supporting surface for accommodating the infant. The air flows upwardly along the side walls of the incubator hood to form an air curtain arranged in surrounding relationship to the infant. An air return channel conducts the air from the vicinity of the top wall of the incubator hood to an air return space below the supporting member. A blower moves the air through the air return channel and into the air return space from where the air can flow upwardly through the air supply opening. Because of the air curtain, there is a temperature gradient only in the vertical direction; however, in the horizontal direction, the temperature gradient is virtually zero so that all regions of the body of the infant lying on the supporting surface are warmed by air at a uniform temperature. In addition, the formation of condensate in the air return channel is prevented because the air curtain and the air return channel are completely within the space enclosed by the base of the incubator and the incubator hood mounted thereon.

18 Claims, 6 Drawing Sheets

INCUBATOR FOR INFANTS

FIELD OF THE INVENTION

The invention relates to an incubator for infants wherein air is supplied from air supply openings arranged between the side walls of the incubator hood and the supporting member defining a supporting surface for accommodating the infant.

BACKGROUND OF THE INVENTION

Incubators provide neonatal care for newborns and especially for prematures. An important task of the incubator is to supply fresh air to the infant and to maintain the temperature of the infant. For this purpose, air circulating systems are generally provided wherein the air is circulated by at least one blower. In addition, an air preparation unit is provided for maintaining the temperature of the air and adding moisture thereto and enriching the circulated air with oxygen as required.

U.S. Pat. No. 3,782,362 describes an incubator wherein the temperature-regulated air is blown up on three sides of the member defining the supporting surface for the infant and is conducted downwardly below this member at a fourth side thereof. It is a disadvantage of this arrangement that one end of the supporting surface for the infant is not warmed and this perforce leads to large temperature differences as a consequence of air layers having respectively different degrees of warmth and as a consequence of side walls having different degrees of heat.

In a special embodiment of this known incubator, the air is received by an air return channel directly below the top wall of the incubator and is conducted downwardly. This air return channel is disposed outside of the incubator interior thereby causing condensate to form at lower ambient temperatures and this, in turn, is associated with hygienic problems.

SUMMARY OF THE INVENTION

It is an object of the invention to provide an incubator wherein an optimal constant temperature is provided above the supporting surface on which the infant rests. It is a further object of the invention to provide an incubator wherein the danger of the formation of condensate in the air return channel is avoided.

The incubator of the invention maintains an environment for an infant. The incubator includes: a base; an incubator hood seated on the base so as to define an enclosed space therewith; an elongated supporting member having an upper supporting surface and being mounted on the base so as to partition the enclosed space into an infant compartment above the supporting surface and an air return space below the supporting member; the incubator hood having a top wall and contiguous side walls extending upwardly from the base to the top wall; the supporting member having a periphery and the supporting surface defining a peripheral region adjacent the side walls and extending around the entire periphery of the supporting member; air supply aperture means extending along the peripheral region for passing air from the air return space into the infant compartment so as to flow upwardly as an air curtain along all of the side walls in surrounding relationship to the supporting surface and the infant; an air return channel extending upwardly within the enclosed space from the air return space to an elevation in the vicinity of the top wall; the air return channel having an air intake opening at said elevation for collecting and receiving the air flowing upwardly along the side walls; and, blower means for moving the air through the air return channel and into the air return space from where the air can flow upwardly through the air supply aperture means.

According to one embodiment of the invention, the air supply aperture means includes an opening arranged on all sides of the supporting member defining the supporting surface and an advantage of the invention is seen in that a warm-air curtain is provided on all sides of the supporting surface because of this opening and this air curtain ensures an optimal constant temperature across the supporting surface. The heat loss produced by heat radiating from the infant is avoided because the walls of the incubator are heated on all sides around the supporting surface. The air return channel disposed inside the incubator hood has the same temperature as the air to be returned so that water condensate cannot form.

An undesired turbulence of the air in the vicinity of the infant lying on the supporting surface is avoided because the air intake opening of the air return channel is at a substantial elevation above the infant. Preferably, the air intake opening of the return channel is at an elevation above the supporting surface of between 0.6 to 0.9 times the distance measured from the supporting surface to the top wall of the incubator hood.

An unobstructed access from all sides to the infant lying on the supporting surface is provided because the air return channel is disposed at the peripheral region of the supporting surface.

A clear view of the supporting surface from all directions is assured by configuring the air return channel from a material which is transparent.

A blower for circulating the air is mounted below the lower end of the air return channel so that the blower can draw the air from the channel by suction. The air is then pressed into the air return space below the supporting member defining the supporting surface and can then rise again from this space through the air supply opening. The blower can also be mounted within the air return channel.

An optimal conduction of air is obtained when the air return channel is provided with a collecting channel. A flat member is mounted in the upper region of the hood interior and has a flat surface extending below the top wall of the incubator hood. The flat member and the top wall of the incubator hood are separated by a gap and conjointly define the collecting channel into which the rising air is drawn by suction. This collecting channel can be provided with a continuous uninterrupted air intake opening along its periphery or with a plurality of air intake openings along its periphery. In this embodiment, the collecting channel is formed essentially as a double wall with the top wall of the incubator hood and the flat member constituting the double wall.

The air rising along the walls of the incubator hood is received at the top wall of the incubator hood by the collecting channel so that turbulence or a concentrated flow of the air is eliminated which could otherwise occur along the long path of the air from the air supply openings to the air return channel arranged at one end of the incubator. In this way, the air of the air curtain is more evenly distributed as the air rises along all four side walls of the incubator hood. A draft-free circulation of air and an optimal control of temperature to a constant value across the supporting surface are provided as a consequence of the way in which air is circulated in the incubator of the invention.

According to another embodiment of the collecting channel, a conduit having a plurality of air intake openings or perforations formed in the wall of the conduit can be arranged in the upper region of the incubator interior. The collecting channel configured in this manner can extend from the air return channel as an extended arm above the longitudinal center line of the longitudinally extending supporting surface.

In all of the embodiments of the invention, a substantially uniform curtain of rising tempered air is provided along all four side walls of the incubator. With this air curtain, there is a temperature gradient only in the vertical direction; however, in the horizontal direction, the temperature gradient is virtually zero so that all regions of the body of the infant lying on the supporting surface are warmed by air at a uniform temperature.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
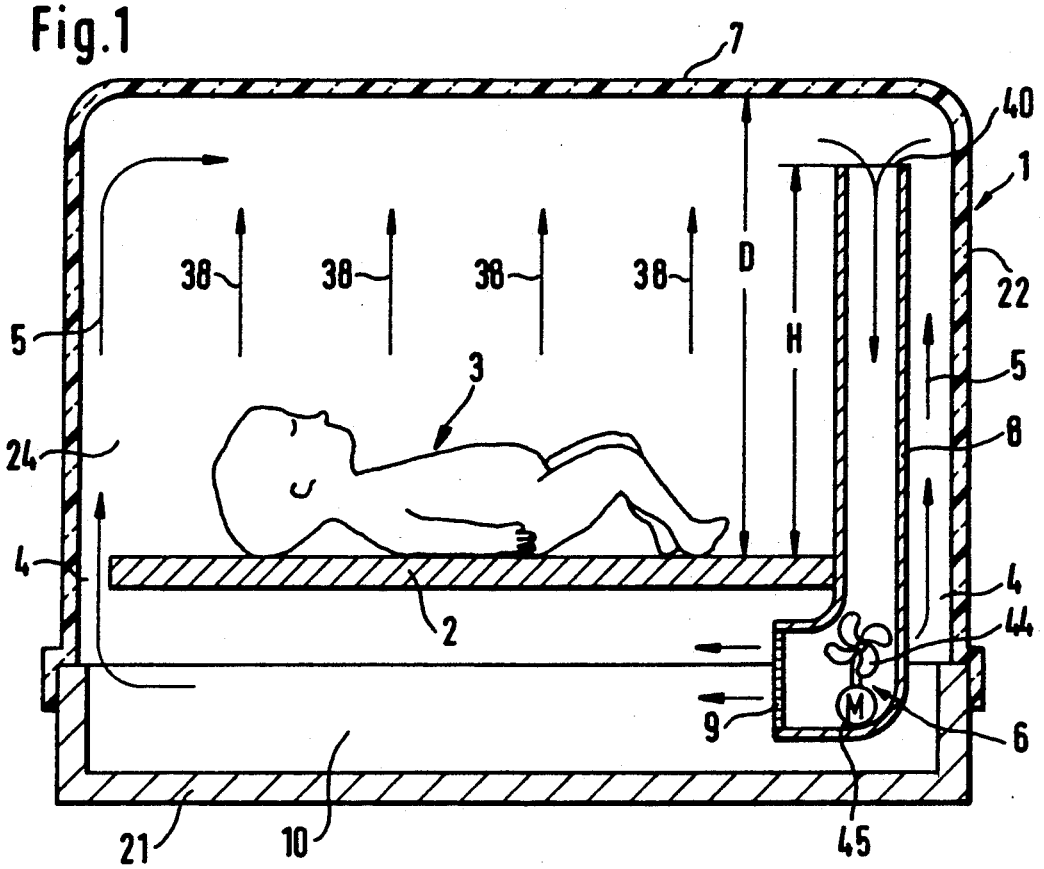
FIG. 1 is a side elevation view according to an embodiment of the incubator of the invention showing the blower unit mounted in the air return channel.
Figure 2:
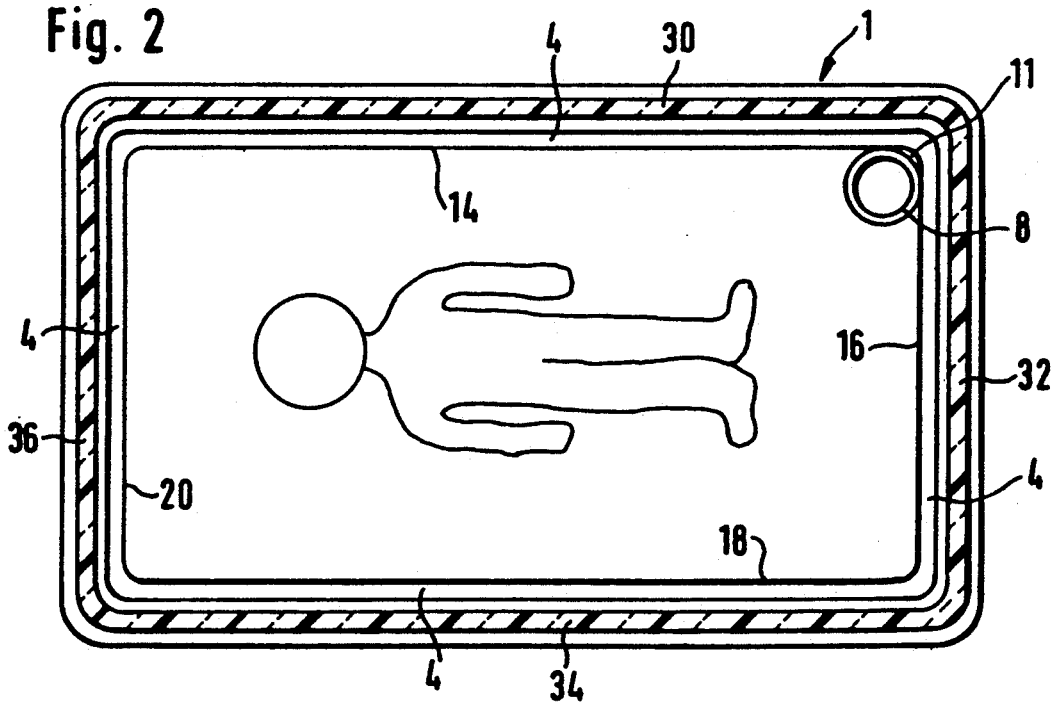
FIG. 2 is a plan view of the incubator of FIG. 1.
Figure 3:
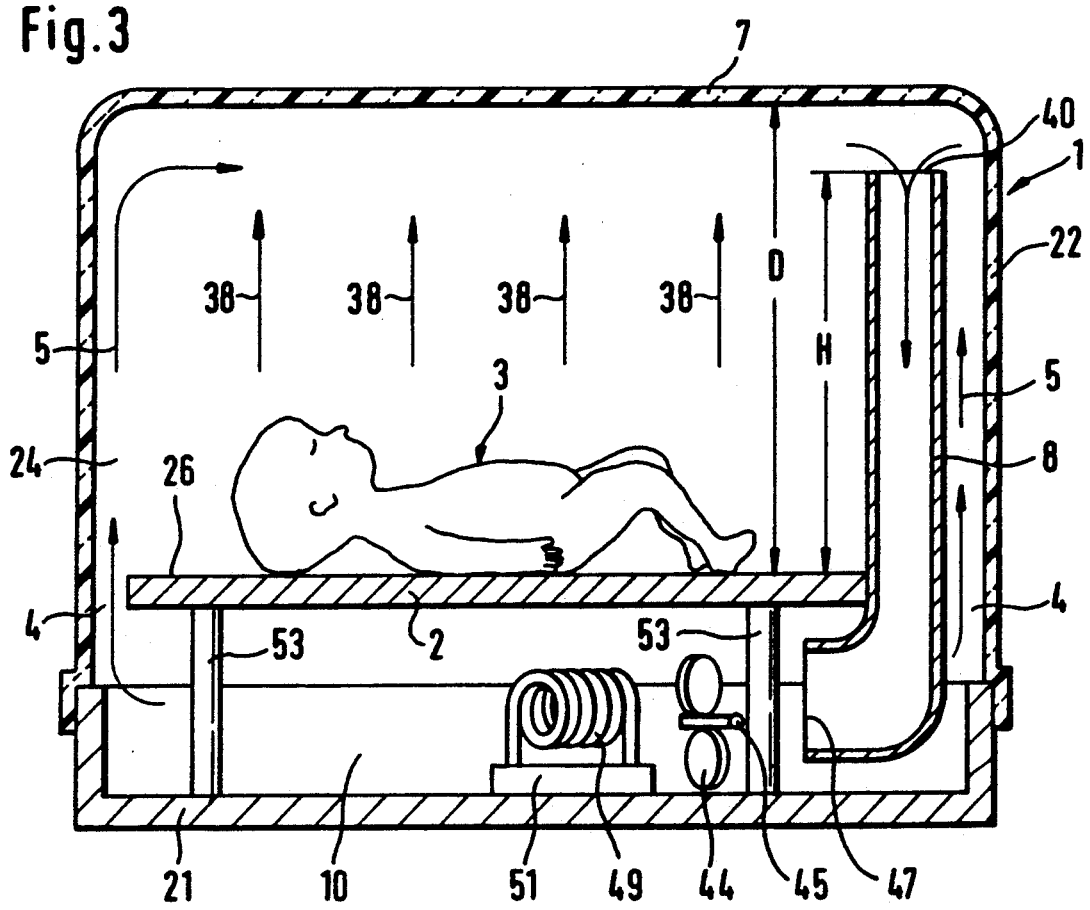
FIG. 3 is a side elevation view of another embodiment of the incubator of the invention wherein the blower is mounted outside of the air return channel.

Referring to FIGS. 1 to 3, the incubator 1 includes a base 21 for accommodating various equipment and an incubator hood 22 which is removably mounted on the base. The incubator hood 22 and the base 21 conjointly define an enclosed space and an elongated supporting member 2 is mounted on the base 21 so as to partition this enclosed space into an infant compartment 24 and an air return space 10. The supporting member 2 defines a supporting surface 26 which supports the infant usually with a cot interposed between the infant 3 and the supporting surface. The lateral edges (14, 16, 18, 20) of the supporting member 2 and the four side walls (30, 32, 34, 36) of the incubator hood 22 conjointly define a continuous uninterrupted air supply opening 4 extending around the periphery of the supporting member. Temperature-regulated air rises along the four walls (30, 32, 34, 36) to form a continuous warm-air curtain in surrounding relationship to the infant. The portion of this curtain along wall 30 is represented by upwardly-directed arrows 38.

An air return channel 8 is mounted at a corner of the incubator 1 as shown in FIG. 2 and has an opening 40 lying close to the top wall 7 of the incubator hood 22. The opening 40 is at an elevation H above the supporting surface 26 which is preferably between (0.6 D) and (0.9 D) where D is the distance between the supporting surface 26 and the top wall 7 of the incubator hood 22.

A blower unit 6 draws air into the opening 40 of the air return channel 8 via suction and directs this air to a temperature-regulating unit in the form of a heater 9. The fan 44 is driven by motor 45 and causes the air to flow through the heater 9 and then forces this air into the air return space 10 below the supporting member 2. The air then again rises uniformly through the air supply opening 4. The heater 9 can be a wire grid or be formed to have a honeycomb configuration.

In the embodiment of FIG. 1, the air return channel 8 is mounted at a corner of the supporting member 2 so that access to the infant 3 is as unobstructed as possible. The incubator hood 22 and the air return channel 8 are preferably made of transparent material such as plexiglass. The base 21 is preferably made of polyurethane molded plastic.

The uniform curtain of air rising along all four walls (30, 32, 34, 36) of the incubator provides for a temperature gradient only in the vertical direction; however, the temperature gradient in the horizontal direction is virtually zero. Accordingly, all regions of the body of an infant 3 lying on the supporting surface 26 are warmed by air at a uniform temperature.

The blower unit 6 can also be mounted outside of the air return channel 8 as shown in the embodiment of FIG. 3. Here the fan 44 of the blower unit is mounted just outside the outlet opening 47 of the channel 8. In this embodiment, the heater includes a heater coil 49 and a supply unit 51 and is mounted within the air return space 10. The air is drawn by suction from the channel 8 and moved by the fan 44 across the heater coil 49.

The air return space 10 is essentially a clear unobstructed channel to facilitate the flow of air to the air supply opening 4. The supporting member 2 is mounted on the base 21 by appropriate mounting means represented schematically by supports 53. The supports 53 have a thickness relative to the width of the space 10 so that they do not significantly obstruct the flow of air through this space to the air supply opening 4.

Figure 4:
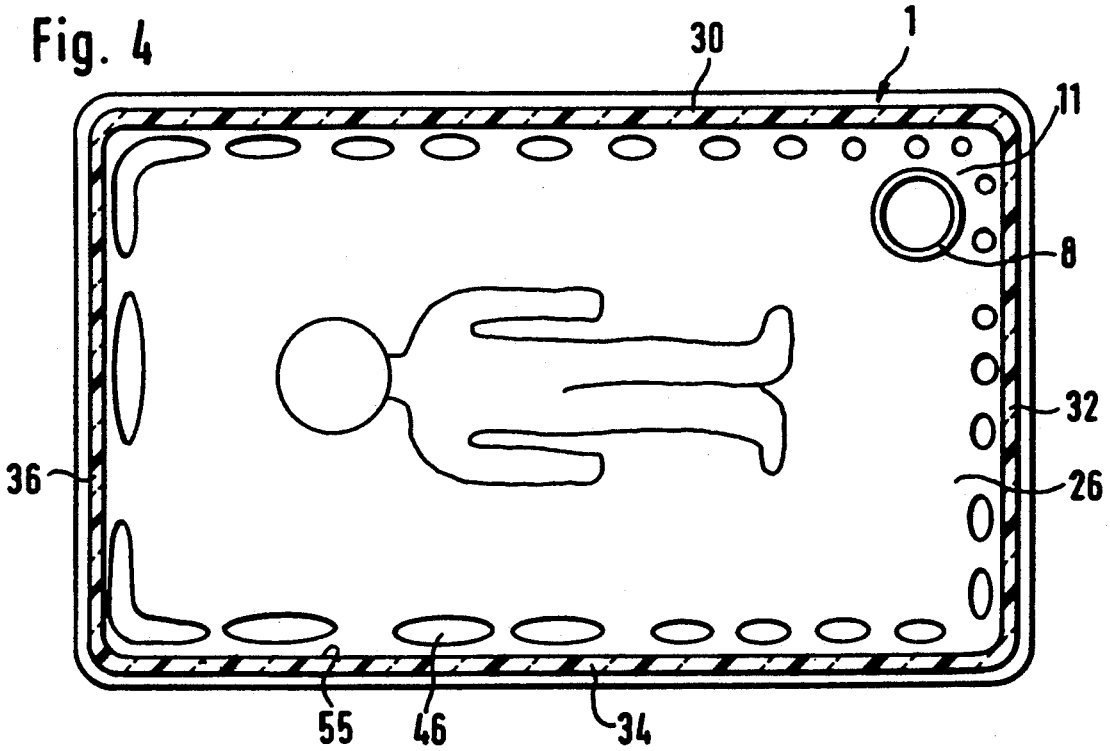
FIG. 4 is a plan view of an incubator of the kind shown in FIGS. 1 to 3 having a plurality of air supply openings in lieu of a single continuous uninterrupted air supply opening.

Attention is called to the fact that it is not necessary to provide only a single uninterrupted opening 4 to achieve the warm-air curtain. Instead of the uninterrupted opening 4, a plurality of openings 46 can be provided between the side walls (30, 32, 34, 36) of the incubator and the support member 2. As shown in FIG. 4, the openings 46 can be formed in the supporting member 2 so that the infant compartment 24 communicates directly with the space 10 below the supporting member. In FIG. 4, the lateral edges of the supporting member 2 are in contact engagement with the side walls (30, 32, 34, 36). The edges of the supporting member 2 and the side walls of the hood conjointly define a separating interface 55 to permit removal of the hood 22 from the base 21.

The apertures 46 can vary in size to compensate for variations in the flow pressure of the air in the air return space 10. Thus, in the embodiment of FIG. 4, the apertures 46 at the right-hand end of the supporting surface 26 have a smaller pass-through cross section than the apertures farther away from the outlet opening 47 of the air return channel 8.

The incubator of the invention can be provided with a front flap for accessing the infant without first removing the hood 22. The front flap could be hinged to the base 21 in the manner shown in U.S. Pat. No. 4,846,783 incorporated herein by reference.

Figure 5:
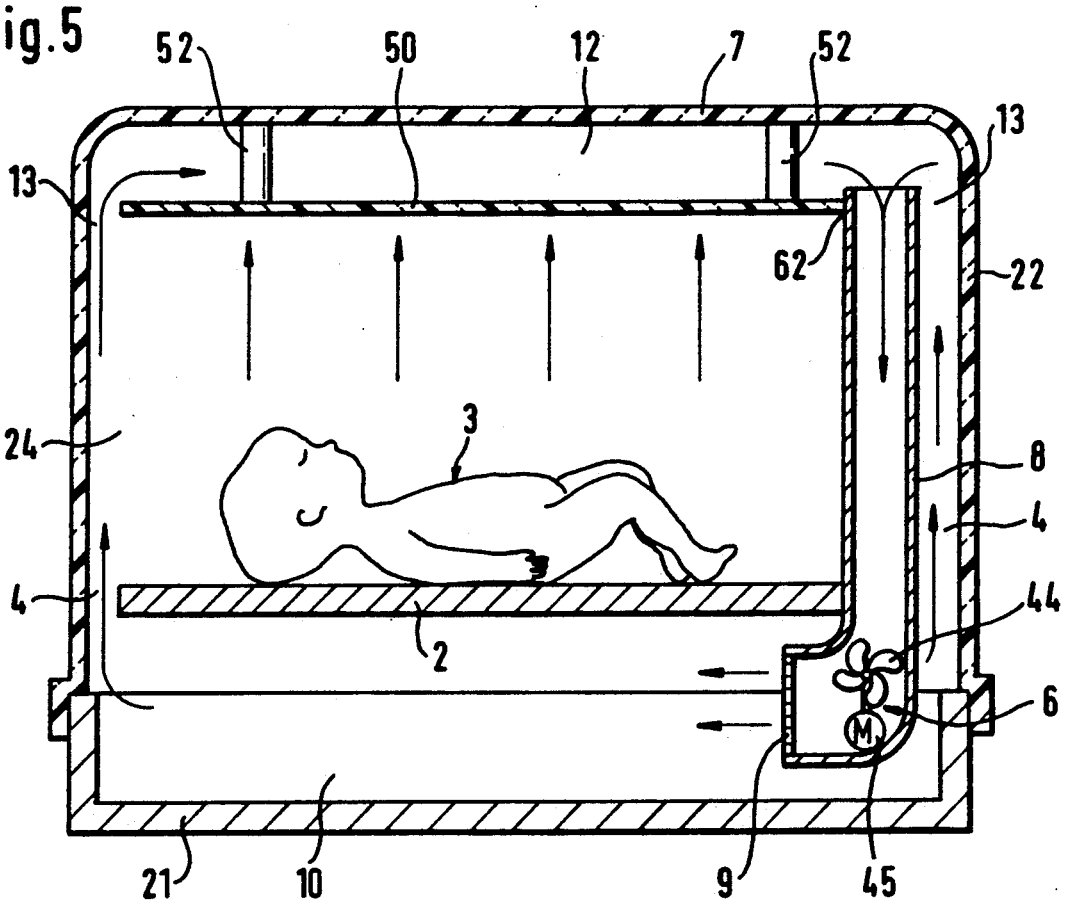
FIG. 5 is a side elevation view of another embodiment of the incubator of the invention which includes a collecting channel for collecting the air rising along the side walls of the incubator hood.

In the embodiment of the incubator shown in FIG. 5, a collecting channel 12 is provided which communicates with the air return channel 8. The collecting channel 12 is conjointly defined by the top wall 7 of the incubator hood 22 and a transparent intermediate plate 50. The plate 50 has substantially the same length and width as the supporting member 2 and extends substantially parallel to the top wall 7 of the incubator hood 22. A plurality of spacers 52 support the intermediate plate 50 below the top wall 7. The spacers 52 are circular when viewed in cross section and have a small diameter relative to the width of the channel 12 so that they do not significantly obstruct the flow of air into and through the channel 12.

The side walls (30, 32, 34, 36) of the incubator hood and the peripheral edges (54, 56, 58, 60) of the intermediate plate 50 conjointly define a peripheral air intake opening 13 which extends along the periphery of the plate 50. The warm air rising along the side walls of the incubator hood is drawn through this air intake opening 13 by suction. The flat configuration of collecting channel 12 and the intake opening 13 disposed on the periphery of the plate 50 produces a vertical air flow along all inside surfaces of the side walls (30, 32, 34, 36) of the incubator hood 22 without producing turbulence in the vicinity of the infant 3.

Figure 6:
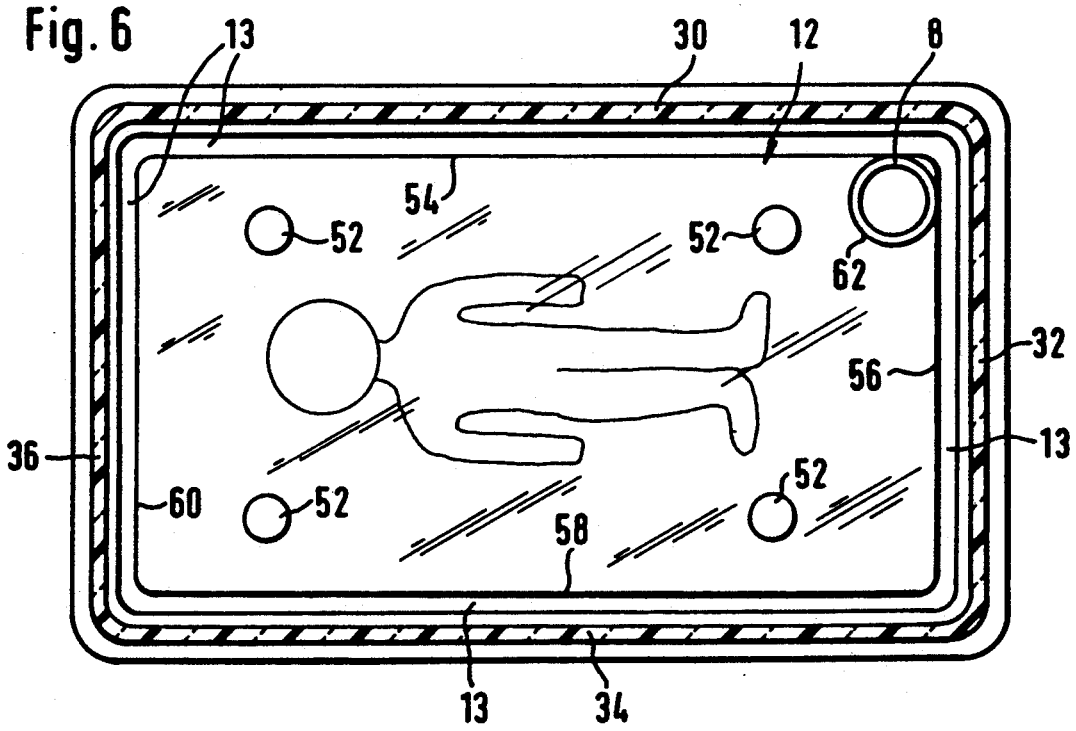
FIG. 6 is a plan view of the incubator of FIG. 5.

The air intake opening to the channel 12 need not be a single opening 13 as shown in FIG. 6. Thus, the plate 50 can be configured so that the peripheral edge thereof is in contact engagement with the side walls of the incubator hood 22. The air intake to the channel 12 could then be a plurality of openings (not shown) formed in the plate 50 along the peripheral edge region thereof in the manner discussed above for the apertures 46 formed in the supporting member 2.

The hood 22 can be removed from the base 21 so that air return channel 8 and intermediate plate 50 conjointly define a separating interface 62. Thus, when the hood 22 including plate 50 is lifted off the base 21, the air return channel 8 remains mounted on the base. The interface 62 can, for example, be along a circular opening formed in the plate 50 for receiving the channel 8.

Figure 7:
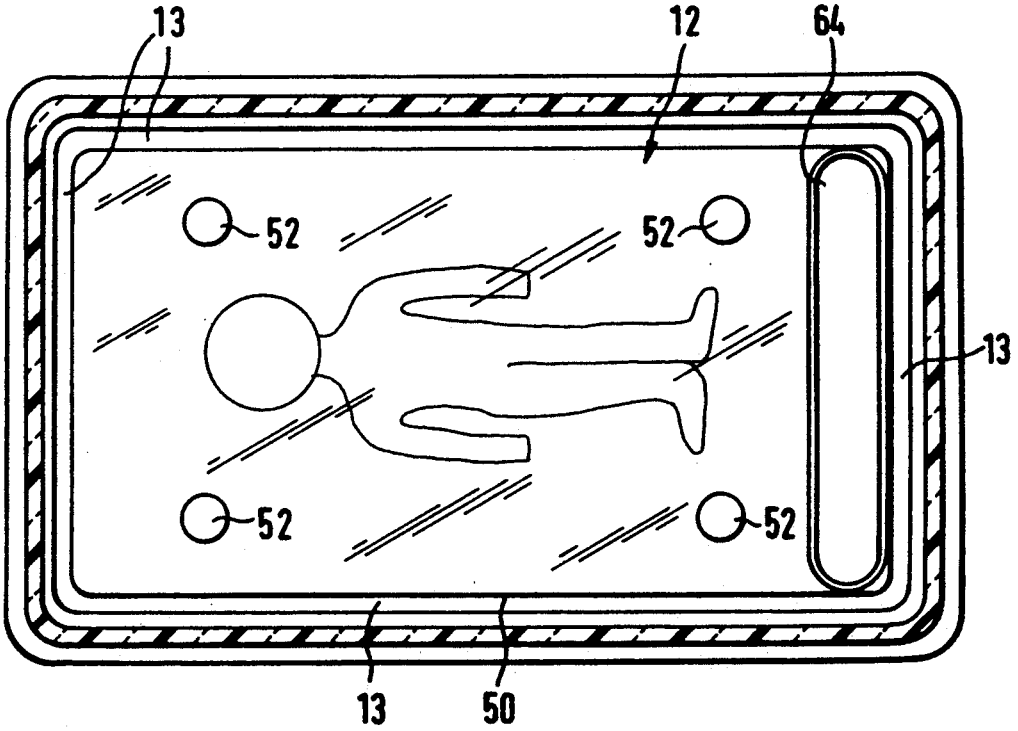
FIG. 7 is a plan view of an incubator which corresponds to the one shown in FIGS. 5 and 6 except that an air return channel is provided having a flat elongated configuration when viewed in section.

It is not necessary that the air return channel 8 have a circular wall. A flat elongated air return channel 64 can be provided as shown in FIG. 7.

Figure 8:
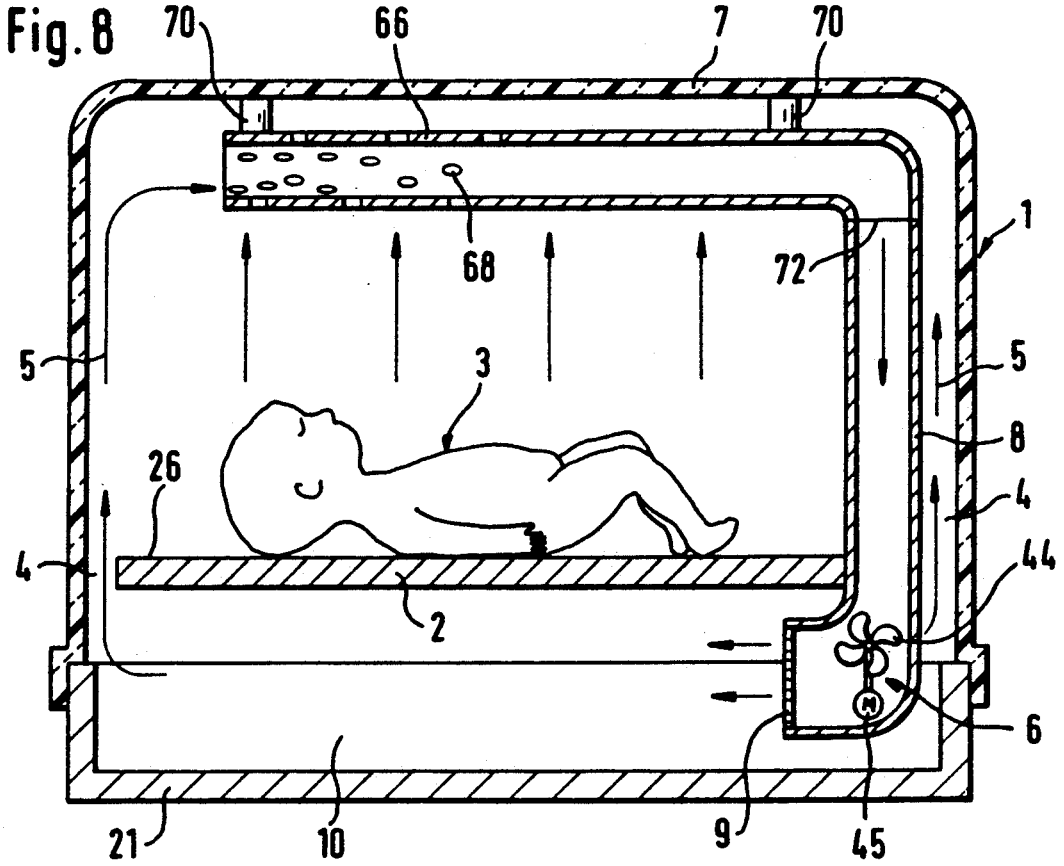
FIG. 8 is a side elevation view of another embodiment of the incubator of the invention wherein a perforated conduit is provided to collect the air rising upwardly along the side walls of the incubator hood.
Figure 9:
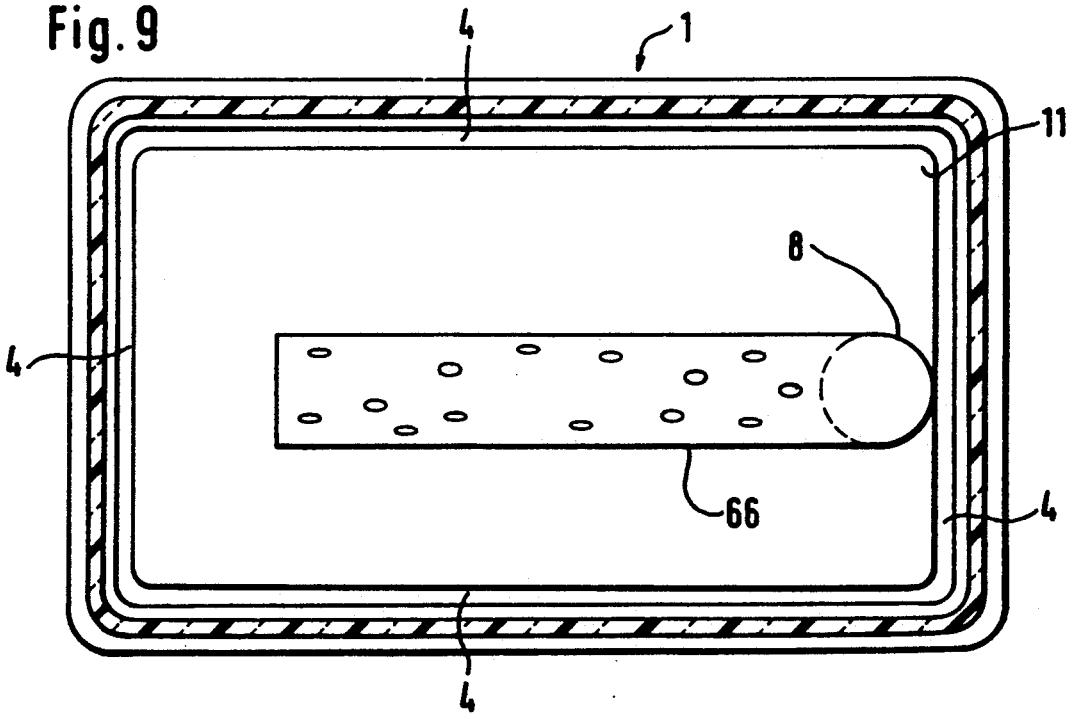
FIG. 9 is a plan view of the incubator of FIG. 8 showing the arrangement of the perforated conduit parallel to the longitudinal center line of the supporting member.

In lieu of the collecting channel shown in FIG. 5, a perforated collecting tube 66 can be arranged just below the top wall 7 of the incubator hood as shown in FIG. 8. The tube 66 is preferably made of transparent material such as plexiglass and collects the air rising along the side walls of the incubator through perforations 68 formed in the tube wall. The perforated collecting tube 66 can be arranged just beneath the top wall 7 of the hood 22 so that the tube is disposed above the longitudinal center line of the supporting member 2 as shown in FIG. 9 wherein the outline of the infant is omitted for clarity. A pair of spacers 70 can be provided for mounting the tube 66 to the top wall 7 of the incubator hood. A separable interface 72 is provided between the collecting tube 66 and the air return channel 8.

Figure 10:
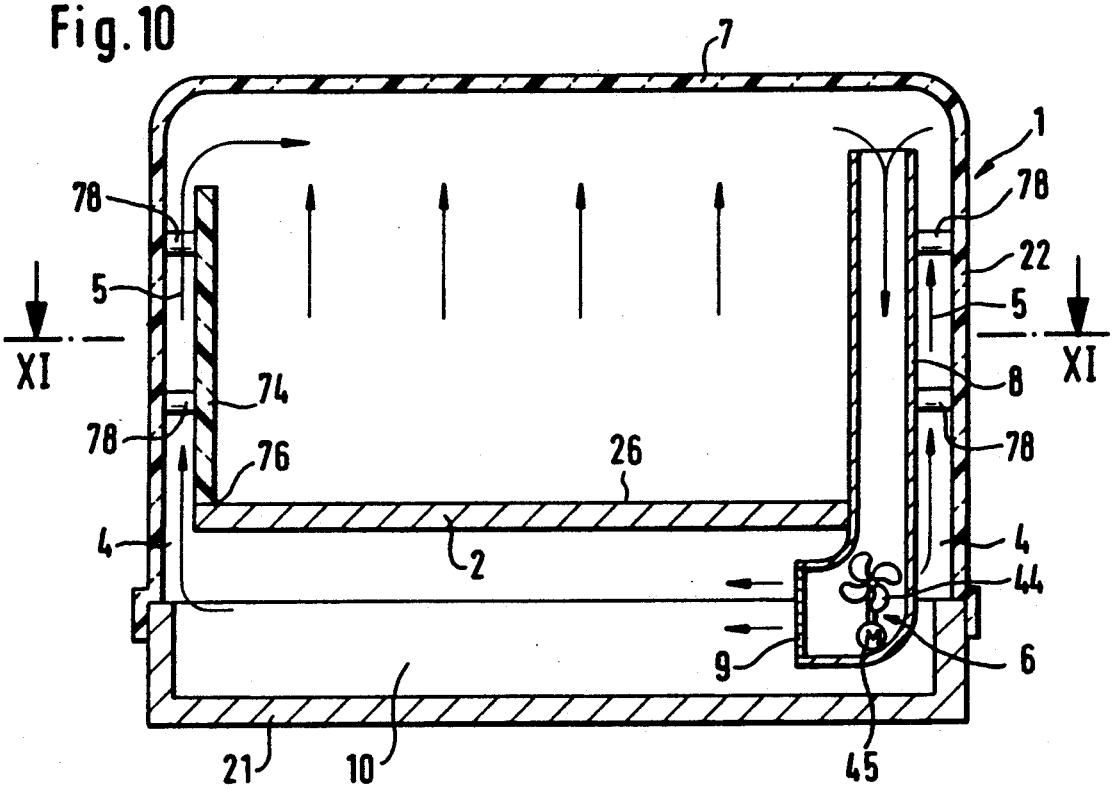
FIG. 10 is a side elevation view of still another embodiment of the incubator of the invention wherein an ancillary wall is mounted via spacers to the side walls of the incubator hood; and, FIG. 11 is a plan section view taken along line XI—XI of FIG. 10.
Figure 11:
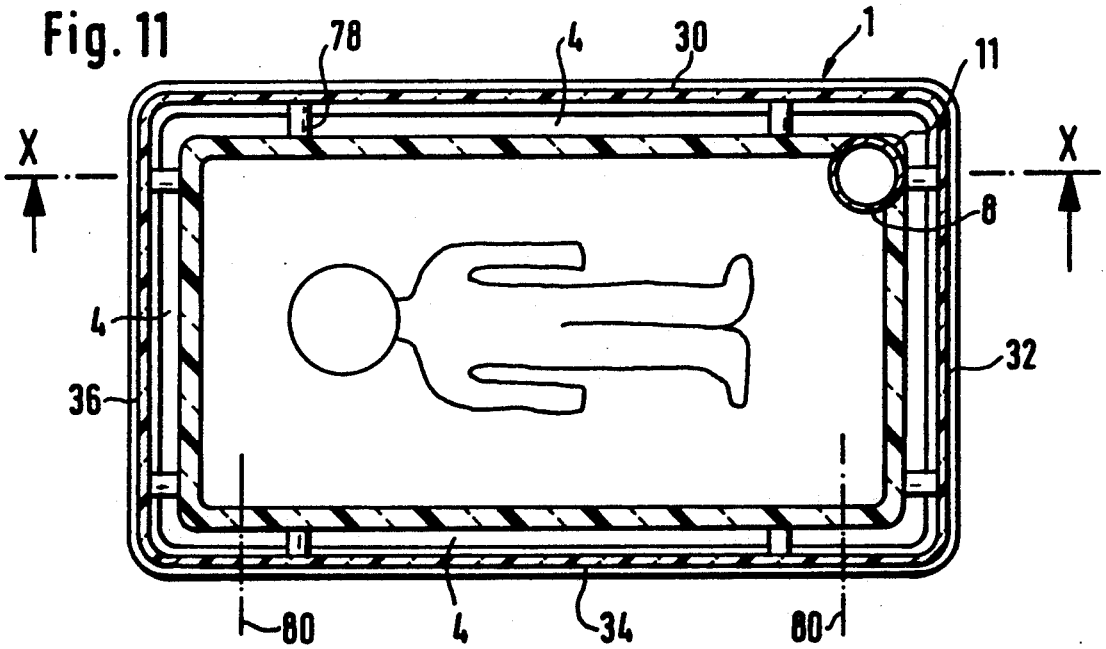

FIGS. 10 and 11 show still another embodiment of the invention wherein the incubator hood 22 is provided with an ancillary wall 74 having a lower edge in contact engagement with the supporting surface 26. The supporting surface 26 and the lower edge of ancillary wall 74 conjointly define a separable contact engaging interface 76. Accordingly, when the incubator hood 22 is lifted from the base 21, the ancillary wall 74 separates from the supporting surface 26 on which it rests when the incubator is seated on the base 21. The ancillary wall 74 is preferably made of transparent material such as plexiglass and is mounted to the side walls (30, 32, 34, 36) via spacers 78. The ancillary wall 74 and the side walls (30, 32, 34, 36) conjointly define an annular space extending around the periphery of the incubator hood 22. Partition interfaces are provided in the front wall extending along lines 80 where a front flap can be provided in the manner disclosed in U.S. Pat. No. 4,846,783 referred to above.

In all of the embodiments shown, the blower unit causes the direction of air flow to be down through the air return channel and up through the air supply openings. However, the air flow could be reversed. Thus, the blower unit 6 could force the air to move from space 10 upwardly through channel 8 and pass downwardly along the side walls and through the openings (4 or 46) back into the space 10.

It is understood that the foregoing description is that of the preferred embodiments of the invention and that various changes and modifications may be made thereto without departing from the spirit and scope of the invention as defined in the appended claims.

What is claimed is

1. An incubator for maintaining an environment for an infant, the incubator comprising:

a base;

an incubator hood seated on said base, said incubator hood having a top wall and contiguous side walls extending upwardly from said base to said top wall so as to define a completely enclosed space therewith;

an elongated supporting member having an upper supporting surface and being mounted on said base so as to partition said enclosed space into an infant compartment above said supporting surface and an air return space below said supporting member;

said supporting member having a periphery and said supporting surface defining a peripheral region adjacent said side walls and extending around the entire periphery of said supporting member;

air supply aperture means extending along said peripheral region for passing air from said return space into said infant compartment so as to flow upwardly as an air curtain along all of said side walls in surrounding relationship to said supporting surface and the infant;

an air return channel within said enclosed space and surrounded by said walls and extending upwardly from said return space to an elevation in the vicinity of said top wall;

said air return channel having an air intake opening at said elevation for collecting and receiving the air flowing upwardly along said side walls; and, blower means for moving the air through said air return channel and into said air return space from wherein the air can flow upwardly through said air supply aperture means.

2. The incubator of claim 1, said air return channel being mounted at the periphery of said supporting member.

3. The incubator of claim 1, said air return channel being made of transparent material.

4. The incubator of claim 1, said blower means being mounted in said return space ahead of said air return channel for drawing air out of said air return channel by suction.

5. The incubator of claim 1, said air supply aperture means being a continuous uninterrupted gap between said side walls and said periphery of said supporting member so as to ensure that said air curtain is substantially uninterrupted.

6. The incubator of claim 1, said air supply aperture means being a plurality of apertures formed in said peripheral region so as to extend through said supporting member to interconnect said return space and said infant compartment; and, said apertures being disposed one next to the other along said peripheral region so as to ensure that said air curtain is substantially uninterrupted.

7. The incubator of claim 6, said air return channel having an air outlet opening in said return space; and, said apertures having respective cross-sectional pass-through areas increasing as a function of distance from said air outlet opening of said air return channel.

8. The incubator of claim 1, further comprising collecting means mounted just below said top wall for collecting the air flowing upwardly along said side walls and for directing the collected air into said air intake opening of said air return channel.

9. The incubator of claim 8, said collecting means including a flat plate mounted in spaced relationship to said top wall so as to conjointly define a collecting channel therewith.

10. The incubator of claim 9, said flat plate being made of transparent material.

11. The incubator of claim 8, said collecting means including a collecting conduit mounted just below said top wall; said collecting conduit having a plurality of air intake openings formed therein for conducting the upwardly flowing air into said collecting conduit; and, said collecting conduit having an outlet opening communicating with said intake opening of said air return channel.

12. The incubator of claim 11, said supporting surface defining a longitudinal center line; and, said collecting conduit being mounted directly above said longitudinal center line.

13. The incubator of claim 1, further comprising an ancillary wall mounted on said side walls to define an annular passage extending from said air supply aperture means to an elevation corresponding approximately to said elevation of said air intake opening of said air return channel.

14. The incubator of claim 13, said ancillary wall being made of transparent material.

15. The incubator of claim 1, said supporting surface defining a longitudinal center line; and, said air return channel being a flat channel mounted at a longitudinal end of said supporting member so as to extend transversely to said center line.

16. The incubator of claim 1, heater means mounted adjacent said blower means to warm the air passed through said air supply aperture means.

17. The incubator of claim 1, said top wall and said supporting surface being separated by a distance D and said air opening of said air return channel being at an elevation H above said supporting surface with said elevation H having a value in the range of 0.6 D to 0.9 D.

18. An incubator for maintaining an environment for an infant, the incubator comprising:

a base;

an incubator hood seated on said base, said incubator hood having a top wall and contiguous side walls extending upwardly from said base to said top wall so as to define an enclosed space therewith;

an elongated supporting member having an upper supporting surface and being mounted on said base so as to partition said enclosed space into an infant compartment above said supporting surface and an air return space below said supporting member;

said supporting member having a periphery and said supporting surface defining a peripheral region adjacent said side walls and extending around the entire periphery of said supporting member;

air aperture means extending along said peripheral region for passing air between said return space and said infant compartment so as to flow as an air curtain along all of said side walls in surrounding relationship to said supporting surface and the infant;

an air channel within said enclosed space and surrounded by said walls and extending upwardly from said return space to an elevation in the vicinity of said top wall;

said air channel having an air opening at said elevation and an air opening in said return space for passing the air flowing along said side walls; and, blower means for moving the air through said air channel and said air aperture means.

* * * * *